United States Patent [19]

Speil

[11] Patent Number: 4,465,038

[45] Date of Patent: Aug. 14, 1984

[54] VALVE TAPPET

[75] Inventor: Walter Speil, Ingolstadt, Fed. Rep. of Germany

[73] Assignee: Motomak Motorenbau Maschinen-Und Werkzeugfabric, Konstruktionen GmbH, Ingolstadt, Fed. Rep. of Germany

[21] Appl. No.: 228,176

[22] Filed: Jan. 26, 1981

[30] Foreign Application Priority Data

Feb. 22, 1980 [DE] Fed. Rep. of Germany ..... 3006644

[51] Int. Cl.[3] ..... F01L 1/24

[52] U.S. Cl. ..... 123/90.55

[58] Field of Search ..... 123/90.55, 90.56, 90.57, 123/90.58, 90.59

[56] References Cited

U.S. PATENT DOCUMENTS

| | | | |
|---|---|---|---|
| 3,509,858 | 5/1970 | Scheibe et al. | 123/90.55 |
| 3,521,608 | 7/1970 | Scheibe | 123/90.57 |
| 4,279,226 | 7/1981 | Lampredi et al. | 123/90.55 |
| 4,367,701 | 1/1983 | Buente | 123/90.55 |

FOREIGN PATENT DOCUMENTS

| | | | |
|---|---|---|---|
| 1808000 | 5/1970 | Fed. Rep. of Germany | 123/90.55 |
| 2754446 | 6/1979 | Fed. Rep. of Germany | 123/90.55 |

*Primary Examiner*—Craig R. Feinberg
*Assistant Examiner*—W. R. Wolfe
*Attorney, Agent, or Firm*—Charles A. Muserlian

[57] ABSTRACT

A valve tappet for internal combustion engines with an overhead cam shaft moveably mounted in the sliding guide directly between the cam and valve stem and which is designed as an automatic play compensating element comprising an outer part and an inner part guided in one another for longitudinal displacement and enclosing between them a pressure chamber connected by a non-return valve to an oil storage chamber charged with oil from the lubricating system of the engine, the outer part cooperates with the sliding guide and the cam and the inner part cooperates with the valve stem, the oil storage chamber being arranged inside the outer part so that it extends exclusively in the radial direction around the inner part and having in its lower portion an oil feed bore and at least one oil transfer bore to the pressure chamber, an oil carrying passage adjoining the oil feed bore inside the oil storage chamber opening freely into the oil storage chamber in the upper portion thereof, the oil carrying passage being formed by the inner surface of the outer wall of the oil storage chamber and by a sheet metal element corresponding with said inner surface.

1 Claim, 13 Drawing Figures

VALVE TAPPET

STATE OF THE ART

Known valve tappets are usually designed so that an oil feed bore is provided in the lower portion of the oil storage chamber without a special oil carrying passage inside the oil storage chamber adjoining the oil feed bore. The oil feed bore has a very small cross section so that oil can not escape from the oil storage chamber by capillary action, even when the motor is stopped for a prolonged time to make sure that there is always sufficient oil when the motor is started again to fill the pressure chamber even when the latter had been emptied during the preceding stoppage.

It was found recently that it could not always be ensured with these known valve tappets that the oil storage chamber would remain filled with oil under certain operating conditions which occur more and more recently. Rather, it was observed that the oil storage chamber was squeezed empty when the motor was started frequently in succession and stopped again after a short operating period. Such operating stages occur in traffic jams, in waiting lines in front of gas stations, etc. To positively prevent the storage chamber from being squeezed empty in these cases, it is necessary to connect an oil carrying passage to the oil feed bore which must always be close to the upper end of the oil storage chamber for construction reasons, and this oil carrying passage must always open freely into the oil storage chamber close to the upper end of the latter. This ensures that the oil level inside the storage chamber can never drop below the upper opening of the oil carrying passage and a sufficient amount of oil is thus always available, even under the unusual operating conditions described above.

A tappet which has such an oil carrying passage inside the oil storage chamber is already known in the U.S. Pat. No. 2,175,467 in which the outer part of the tappet was designed as a casting and the oil carrying passage was molded directly into this casting but such a casting is expensive.

OBJECTS OF THE INVENTION

It is an object of the invention to provide a valve tappet for internal combustion engines with a simple oil carrying passage inside the oil storage chamber. It is another object of the invention to provide existing valve tappets without an oil carrying passage with such a passage in an economical manner.

These and other objects and advantages of the invention will become obvious from the following detailed description.

THE INVENTION

The novel valve tappet of the invention for internal combustion engines with an overhead cam shaft moveably mounted in the sliding guide directly between the cam and valve stem and which is designed as an automatic play compensating element is comprised of an outer part and an inner part guided in one another for longitudinal displacement and enclosing between them a pressure chamber connected by a non-return valve to an oil storage chamber charged with oil from the lubricating system of the engine, the outer part cooperates with the sliding guide and the cam and the inner part cooperates with the valve stem, the oil storage chamber being arranged inside the outer part so that it extends exclusively in the radial direction around the inner part and having in its lower portion an oil feed bore and at least one oil transfer bore to the pressure chamber, an oil carrying passage adjoining the oil feed bore inside the oil storage chamber opening freely into the oil storage chamber in the upper portion thereof, the oil carrying passage being formed by the inner surface of the outer wall of the oil storage chamber and by a sheet metal element corresponding with the said inner surface.

The problem is solved by the invention so that the oil carrying passage is formed, on the one hand, by the inner surface of the outer wall of the oil storage chamber and, on the other hand, by a sheet metal part corresponding with the latter. To accomplish this, for example, a sheet metal part can be provided which bears against the inner surface of the outer wall of the oil storage chamber and which is provided in the area of the oil feed bore with a bead extending up to the upper end of the oil storage chamber, and which is sealed off on all sides with the exception of its upper end, by a sheet metal part extending from the inside toward the inner surface of the outer wall of the oil storage chamber.

In both cases, the sheet metal part can be designed as a segment which covers only the area of the oil feed bore and which is secured on the inner surface of the outer wall of the oil storage chamber by cementing, welding, soldering, etc. On the other hand, however, it is also possible to design the sheet metal part as a cylindrical pipe section which bears tightly on the inner surface of the outer wall of the oil storage chamber. In these cases, the sheet metal part can be clamped at its two front edges between a step on the upper end of the outer wall of the oil storage chamber at one end, and a plate terminating the oil storage chamber at the bottom end.

The sheet metal parts can also be designed as a pipe section with a wall having an undulating cross section which bears tightly with the radially extreme portions of the undulations on the inner surface of the outer wall of the oil storage chamber. Compared to a pipe section with only one bead, such an undulated sheet metal part has the advantage that it need not be positioned exactly during its assembly with regard to the oil feed bore. Since axially extending passages are provided practically over the entire circumference, of which one that is in the range of the oil feed bore will necessarily be operative, alignment of the sheet metal part during the assembly is not necessary.

Furthermore, it is also possible to provide the sheet metal part at its end adjoining the oil feed bore with an integral metal flange directed substantially radially to the inside which forms the hermetic seal of the lower end of the oil storage chamber. In this way, the sheet metal part performs at the same time the sealing function of a separate plate which would otherwise be required.

Another solution of the problem underlying the invention in a tappet of the above-described type can be achieved by forming the outer tappet part of a first cup-shaped part with a cylindrical wall and a closed bottom at its end, and by a second part with a cylindrical outer shell, which fits tightly into the bore of the cylindrical wall of the first part and which passes over at the end adjoining the bottom of the first part into a frustrum-shaped zone facing away from the bottom, which is joined at the other end by a cylindrical zone facing away from the bottom, which receives the inner part, the oil carrying passage, the oil carrying passage being formed by the first and second part at the circumferential point at which the oil feed bore is arranged, which extends in the longitudinal direction and opens freely in the proximity of the bottom into the oil storage chamber. This design has the advantage that, similar to the above described embodiment, only two parts are required for the formation of the outer tappet part including the oil carrying passage which can be designed in a very simple manner as drawn metal parts.

The second part in the circumferential area of the oil feed bore has a trough-shaped bead extending in the longitudinal direction which terminates freely at the end corresponding with the bottom of the first part, but does not extend at the opposite end to the terminal edge of the second part. On the other hand, it is also possible to provide the first part in the bore of its cylindrical wall with a longitudinal groove starting from the oil feed bore and ending at the bottom which is covered by the smooth cylindrical wall of the second part for the formation of the oil carrying passage.

Referring now to the drawings

Figure 1:
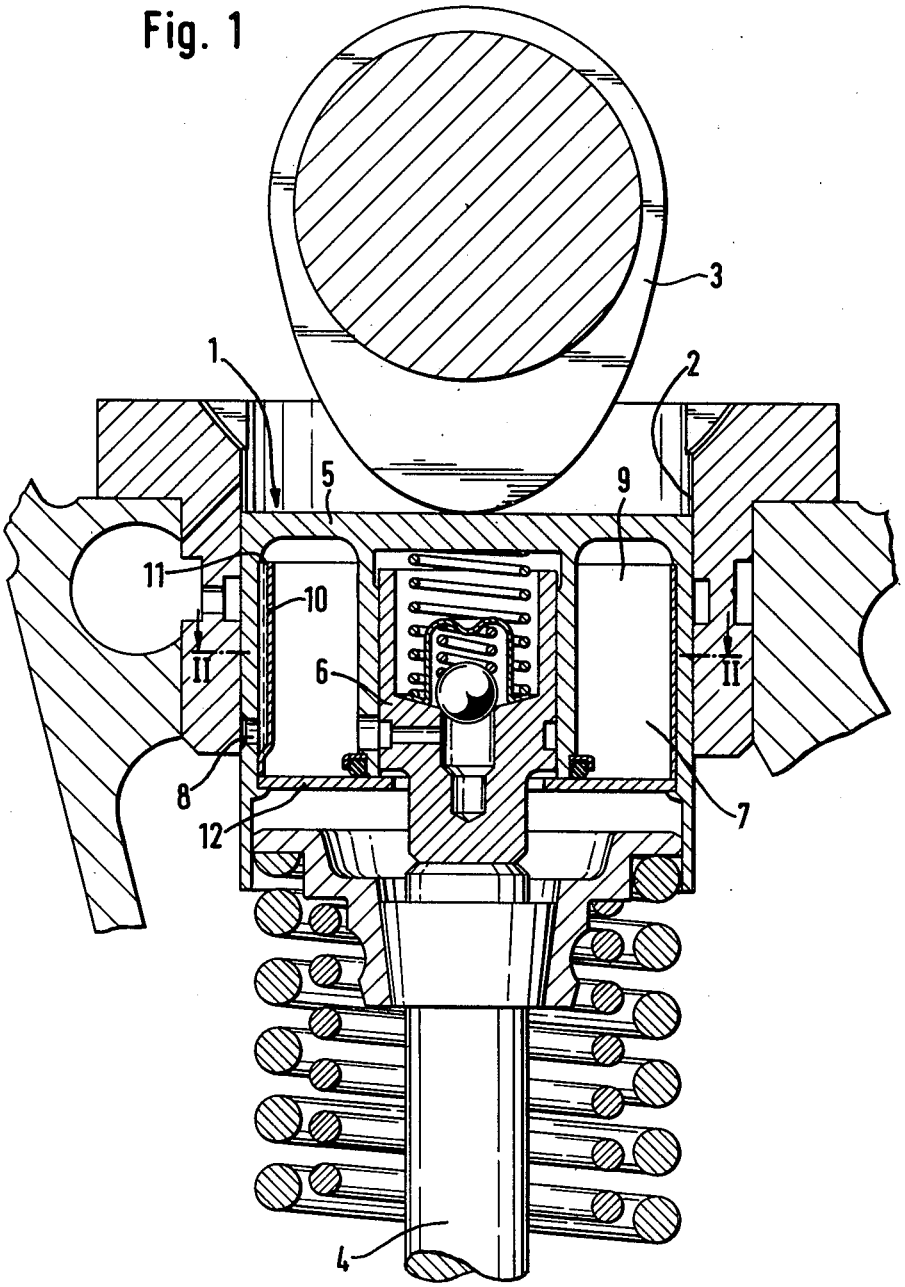
FIG. 1 is a sectional view of a valve tappet of the invention in the installed state between the cam and valve stem.
Figure 2:
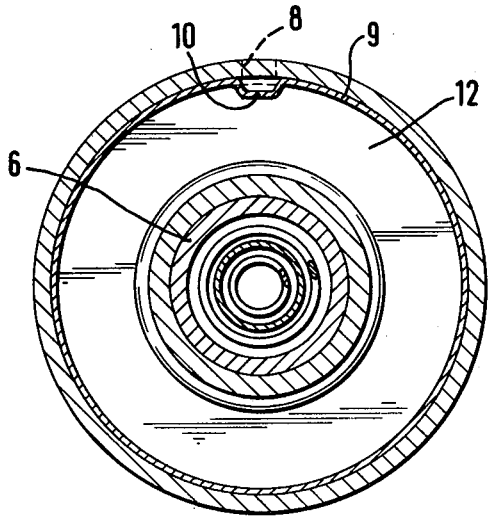
FIG. 2 is a sectional view through the tappet along line II—II of FIG. 1.

In FIGS. 1 and 2, tappet 1 is moveably mounted in a sliding guide 2 between cam 3 at one end and valve stem 4 at the other end and it consists, as known, of an outer tappet part 5 and an inner tappet part 6. The latter is surrounded in ring form by an oil storage chamber 7 arranged in the outer tappet part and oil flows into this oil storage chamber 7 from the lubricant cycle through oil feed bore 8 which must be arranged for construction reasons in the area of the lower end of oil storage chamber 7.

Inside the oil storage chamber is arranged a sheet metal part 9 designed as a pipe section which is provided with a longitudinal bead 10 in the circumferential section corresponding with the oil feed bore 8. Sheet metal part 9 bears at the upper end on a step 11 of outer tappet part 5 and the bottom end on plate 12 terminating the oil storage chamber and sheet metal part 9 bears tightly over this entire circumference on the inner wall of outer tappet part 5 so that the oil can only enter or issue from oil storage chamber 7 through the upper open end of bead 10.

Figure 3:
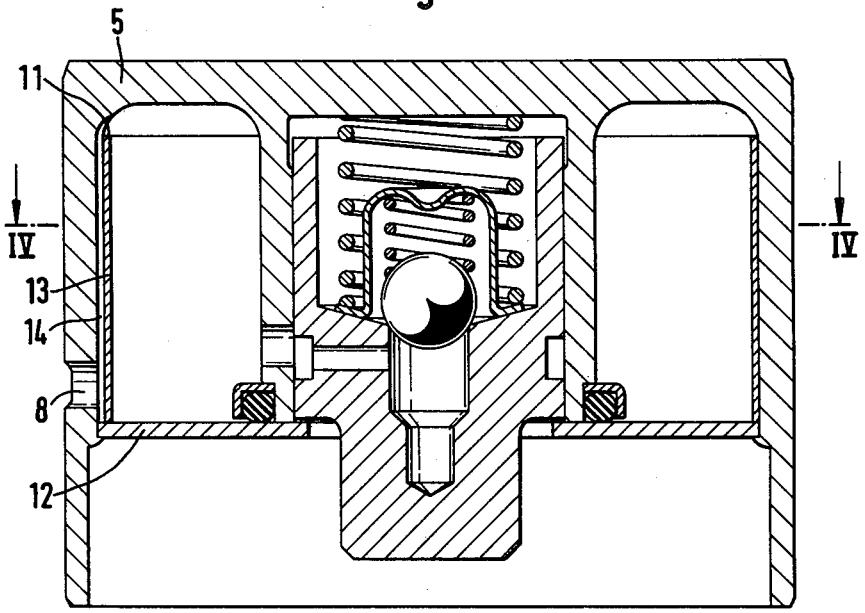
FIGS. 3, 5, 7 and 9 are longitudinal sectional views through different embodiments of tappets of the invention
Figure 4:
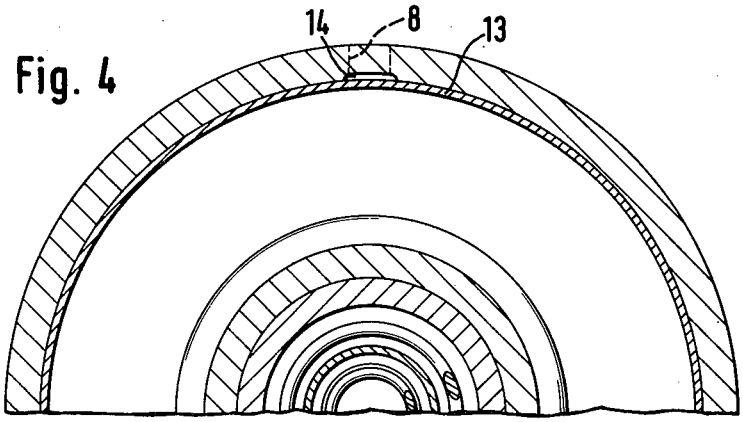
FIGS. 4, 6, 8 and 10 show the respective cross sectional views thereof.

The embodiment shown in FIGS. 3 and 4 differs from the preceding one only in that a sheet metal part 13 is provided which is smooth and cylindrical over its entire surface, while in the inner wall a trough-shaped depression 14 for the formation of the oil carrying passage is provided in the inner wall of outer tappet part 5. Here too, as in the preceding embodiment, a sheet metal part 13 designed as a pipe section is supported between a step 11 at one end and plate 12 at the other end.

Figure 5:
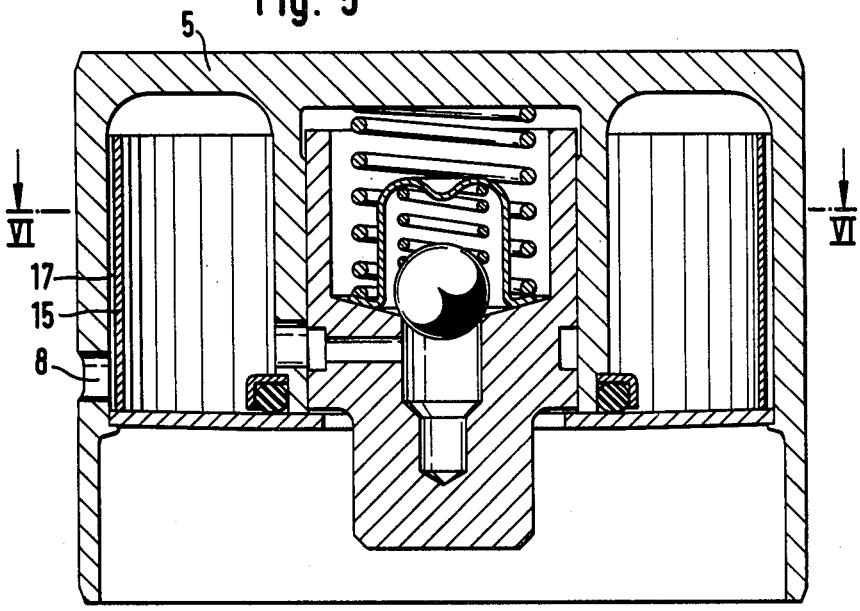
Figure 6:
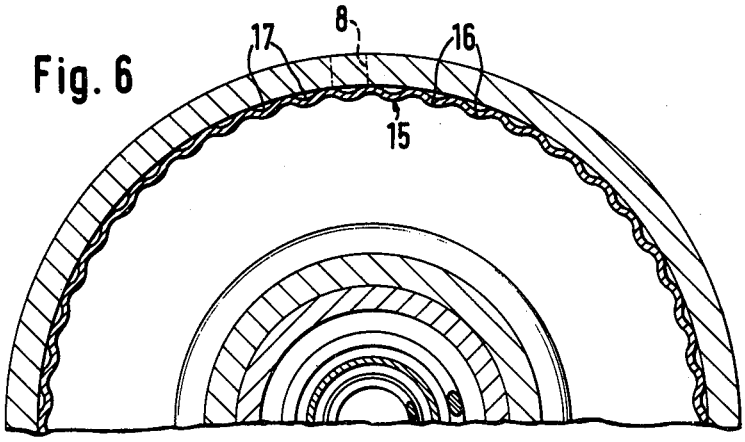

In the embodiment of FIGS. 5 and 6, a sheet metal part 15 is used as a pipe section which is provided over its entire circumference with undulation 16. The extreme radial sections of these undulations 16 bear tightly against the inner surface of the outer wall of outer tappet part 5 so that individual passages 17 extending in the longitudinal direction of the tappet part are formed. The embodiment shows that this sheet metal part 15 can be introduced in any position into the outer tappet part and in any case, one or at most two juxtaposed passages 17 correspond with oil feed bore 8.

Figure 7:
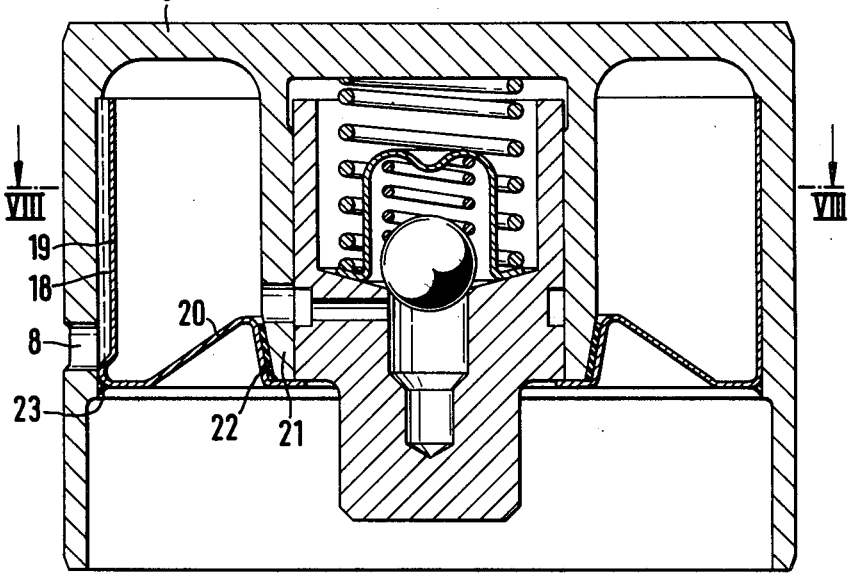
Figure 8:
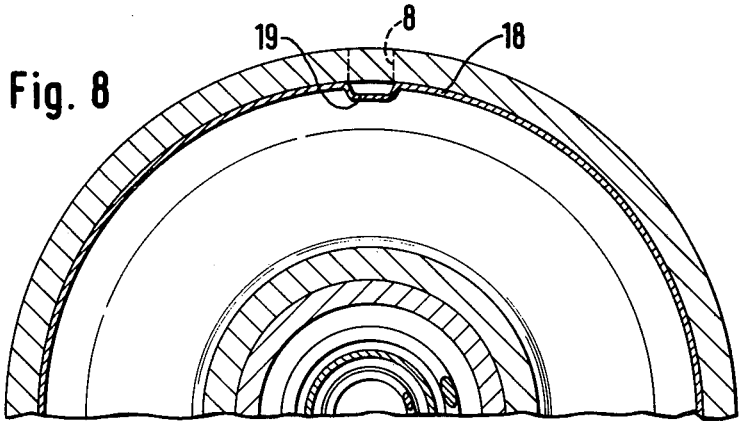

FIGS. 7 and 8 illustrate an embodiment where sheet metal part 18 is used which has a bead 19 on its cylindrical shell as already shown in FIGS. 1 and 2 and this metal part is also provided with a metal flange 20 extending substantially radially to the inside which bears tightly on inner wall 21 defining the oil storage chamber, with the interposition of a gasket 22. Sheet metal part 19 is joined with the outer wall of tappet part 5 by welding. When this sheet metal part is used, a separate part terminating the oil storage chamber at the bottom is not necessary.

Figure 9:
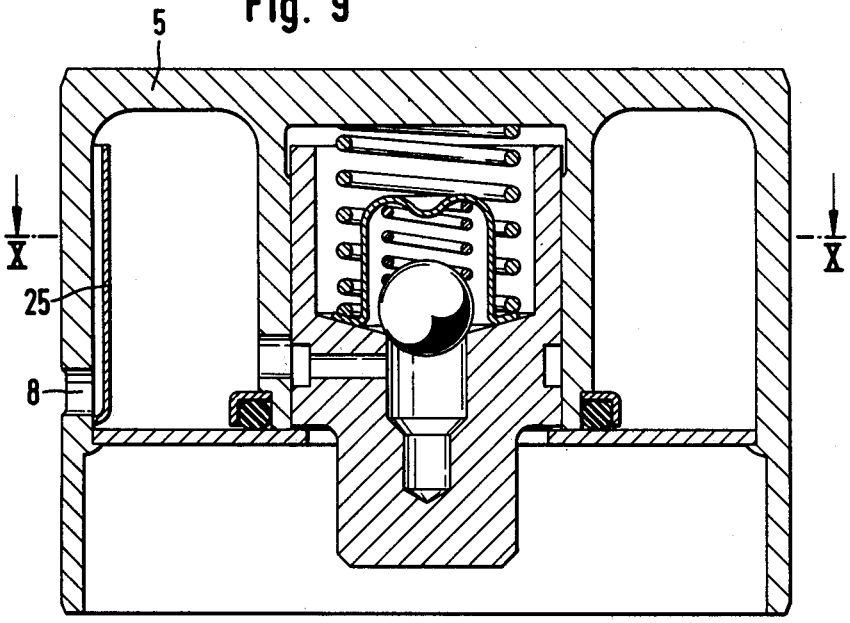
Figure 10:
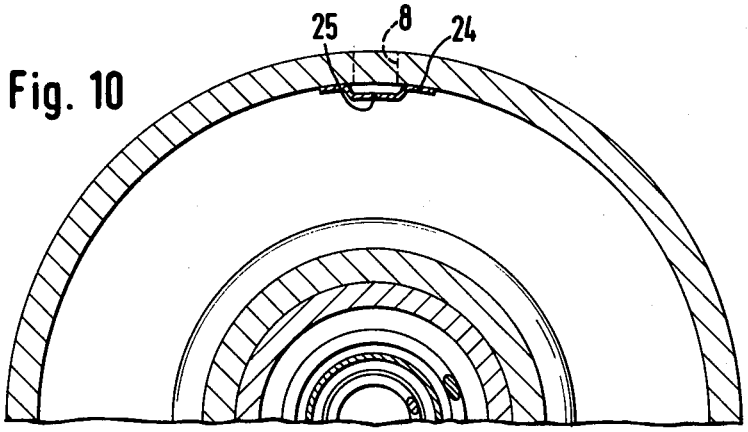

FIGS. 9 and 10 illustrate the possibility of using, instead of a tubular metal part a narrow plate segment which has a bead 25 for the formation of the oil carrying passage and this sheet metal part 24 can be secured to the inner wall of outer tappet part 5 by cementing, soldering, welding or other suitable means.

Figure 11:
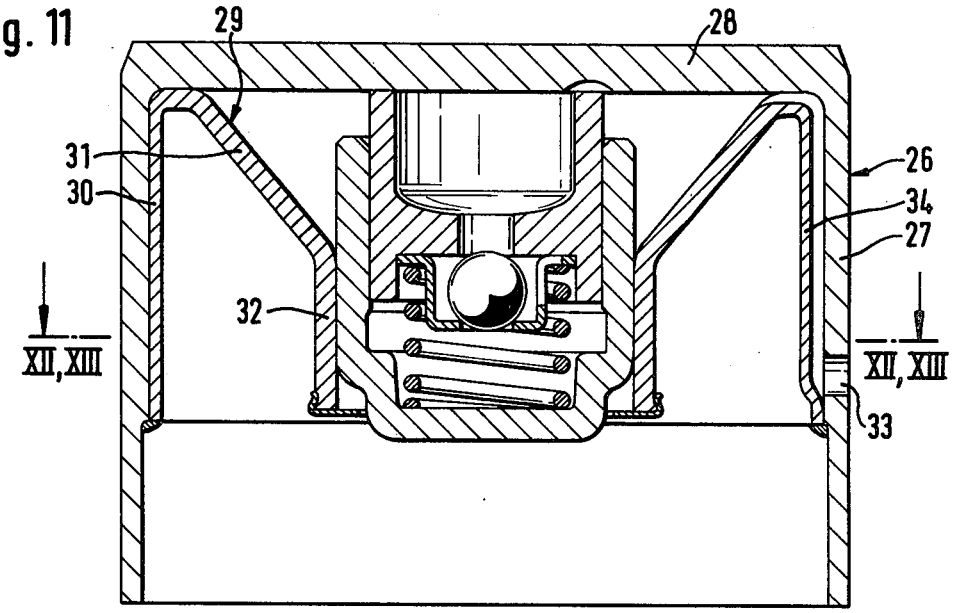
FIG. 11 is a longitudinal sectional view through a different valve construction.

FIG. 11 shows a modified embodiment compared to the previously described embodiments in which the outer tappet part is formed by a first cup-shaped part 26 with a cylindrical wall 27 and a closed bottom 28 at its front end. Into this first cup-shaped part is inserted a second part 29 which has a cylindrical outer shell 30 which fits tightly into the bore of cylindrical wall 27. At its end adjoining bottom 28 of the first part 26, the cylindrical outer shell passes over into a frustum-shaped zone 31 facing away from the bottom which is adjoined at the other end by a cylindrical zone 32 facing away from bottom 28. This cylindrical zone 32 serves to receive the inner tappet part whose design need not be described here in detail.

Figure 12:
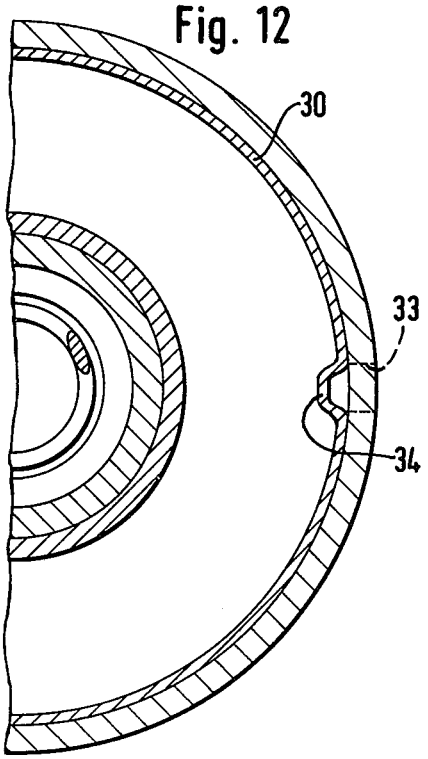
FIGS. 12 and 13 are cross sectional views along lines XII, XIII—XII, XIII of FIG. 11.
Figure 13:
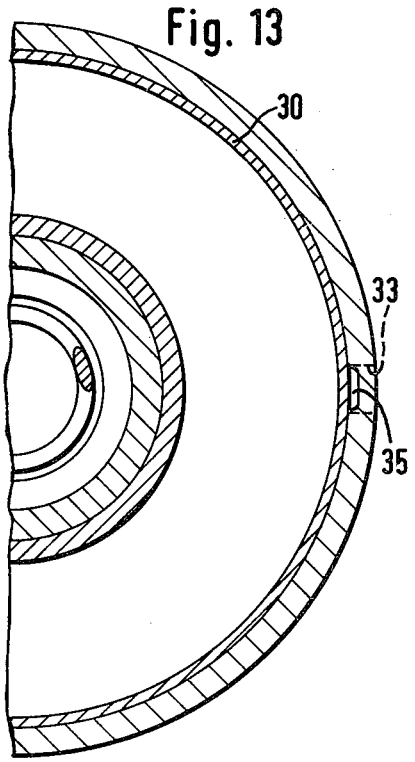

As can be seen from FIG. 11, the cylindrical outer shell of the second part 29 is provided in the circumferential area in which oil feed bore 33 is arranged with a bead 34 extending in the longitudinal direction, which terminates freely at the end facing bottom 28, while it does not extend at the other opposite end down to the terminal edge of the cylindrical outer shell 30. The respective cross section can be seen from FIG. 12. FIG. 13 finally shows a variantion where in a similar manner as shown in FIGS. 3 and 4, the oil carrying passage is formed by a longitudinal groove 35 provided in the cylindrical wall 27 in the circumferential area of oil feed bore 33 while the cylindrical outer shell 33 is smooth and cylindrical over its entire surface.

Various modifications of the valve tappet of the invention may be made without departing from the spirit or scope thereof and it is to be understood that the invention is intended to be limited only as defined in the appended claims.

What I claim is:

1. A valve tappet for internal combustion engines with overhead cam shaft which is moveably mounted in a sliding guide directly between a cam and a valve stem and is designed as an automatic play compensating element, comprising an outer part and an inner part guided in one another for axial displacement, said parts enclosing between them a pressure chamber which is connected by a non-return valve with an oil storage chamber filled with oil from a lubricant cycle of an engine, the outer part cooperates with said cam and sliding guide and the inner part with said valve stem, the oil storage chamber being arranged inside the outer part so that it extends exclusively in radial direction around the inner part with an oil feed bore provided substantially in the center of an outer shell of the outer part which is adjoined by an oil carrying passage on its inside opening freely into the oil storage chamber in the proximity of the upper end of the latter, said outer part being formed by a first cup-shaped part with a cylindrical wall and a closed bottom at one end, and by a second part with a cylindrical outer shell fitting tightly into the bore of the cylindrical wall of the first part and which passes over at one end adjoining the first part into a frustum-shaped zone facing away from the bottom, which is adjoined in turn by a cylindrical zone facing away from the bottom to receive the inner part, the oil carrying passage opening freely into the oil storage chamber in the proximity of the bottom being formed by the first and the second part at a circumferential point at which the oil feed bore is provided said second part having in a circumferential area of said oil feed bore a trough-shaped bead extending in longitudinal direction which terminates freely at the end corresponding with the bottom of said first part but does not extend to the terminal edge of said second part at the opposite end.

* * * * *